United States Patent [19]

Blusseau et al.

[11] Patent Number: 4,899,261

[45] Date of Patent: Feb. 6, 1990

[54] AUTOMOBILE HEADLAMP WITH SMALL HEIGHT AND HIGH FLUX RECOVERY

[75] Inventors: Eric Blusseau, Les-Pavillons-sous-Bois; Norbert Brun, Bobigny, both of France

[73] Assignee: Cibie Projecteurs, Bobigny Cedex, France

[21] Appl. No.: 257,211

[22] Filed: Oct. 13, 1988

[30] Foreign Application Priority Data

Oct. 13, 1987 [FR] France ..... 87 14114

[51] Int. Cl.[4] ..... F21V 13/04

[52] U.S. Cl. ..... 362/61; 362/297; 362/299; 362/308

[58] Field of Search ..... 362/61, 80, 297, 298, 362/299, 308, 339, 340, 343, 346

[56] References Cited

U.S. PATENT DOCUMENTS

| | | | |
|---|---|---|---|
| 1,562,111 | 11/1925 | Matthyssen et al. | 362/299 |
| 2,165,305 | 7/1939 | Ruths | 362/299 |
| 2,262,098 | 11/1941 | Crook et al. | 362/299 |
| 2,407,829 | 9/1946 | Gorder | 362/299 |
| 4,811,174 | 3/1989 | Kanzler et al. | 362/299 |

FOREIGN PATENT DOCUMENTS

| | | |
|---|---|---|
| 36397 | 1/1929 | France . |
| 674139 | 4/1929 | France . |
| 2164435 | 3/1986 | United Kingdom . |

*Primary Examiner*—Stephen F. Husar
*Assistant Examiner*—Richard R. Cole
*Attorney, Agent, or Firm*—Wenderoth, Lind & Ponack

[57] ABSTRACT

A headlamp for an automobile vehicle comprises a luminous filament, a reflector, and a closing glass. According to the invention, the reflector comprises a parabolic base part and side pieces in the form of parabolic cylinders focussed on the filament, and in addition there are deflecting means, for example toroidal lenses, which re-direct the inclined rays of light received from the filament into the horizontal direction, towards the side pieces. A greater proportion of the luminous flux is thus recovered, which enables production of lamps with a small height and with a high efficiency.

11 Claims, 8 Drawing Sheets

AUTOMOBILE HEADLAMP WITH SMALL HEIGHT AND HIGH FLUX RECOVERY

FIELD OF THE INVENTION

The present invention relates generally to headlamps for automobile vehicles, and concerns in particular a headlamp having a small height, which enables a good recovery of the light flux emitted by the lamp, and which forms behind the lens a distribution of light which is particularly well adapted to the desired illuminating function.

BACKGROUND OF THE INVENTION

Current trends in lighting for automobile vehicles are strictly tied to aerodynamic and aesthetic requirements. Thus, modern automobile vehicles comprise a plunging bonnet line and a frontal area of reduced height. It is therefore necessary to correspondingly reduce the height of the vehicle headlamps.

A well known solution to this problem consists of using a headlamp which is conventional in optical design and comprises a lamp the filament (or other light source) of which is focussed in a parabolic reflector, and to truncate the reflector with two flat upper and lower reflecting surfaces.

This solution, although simple, has however a major disadvantage. Since the filament is usually horizontal (axial or transverse), it emits a large amount of the flux towards these surfaces which are inoperative optically and do not cause it to participate in the road beam obtained. In practice the flux recovery in such a lamp rarely exceeds 65%.

Attempts have been made, particularly by the applicant, to improve the flux recovery in such a truncated reflector. For example, the use of complex surfaces for the reflector to decrease the mean focal distance and enable a reflector to be obtained which is deeper, thus giving a better recovery of flux. The results obtained however still leave a margin for improvement.

It is one object of the present invention to reduce the disadvantages of the prior art and to provide a lamp capable of emitting a road beam which, whilst having a greatly reduced height to satisfy the most modern design requirements, produces a light beam of great intensity resulting from a good recovery of the flux emitted by the light source.

Another object of the invention is to give the images of the filament formed by the reflector an orientation which is particularly adapted to the formation of a road beam. In this connection it should be remembered that the visual comfort of a road beam is given, on the one hand, by a point of concentration on the axis of the road (that is to say the optical axis of the lamp) and, on the other hand, by a large width and small depth of the beam.

A further object of the invention is to provide that a large proportion of the images of the filament participating in the formation of the beam are horizontal or slightly inclined.

SUMMARY OF THE INVENTION

According to the present invention, a headlamp for an automobile vehicle, of the kind comprising a light, a reflector defining an optical axis and a closing glass, is characterized in that the reflector comprises a base part substantially in the form of a paraboloid of revolution focussed on the source, and side pieces in the form of parabolic cylinders having a vertical generatrix; and deflecting means extending near the source substantially over the full height of the lamp and adapted to deflect the direction of the light rays coming from the source in order to re-emit them in an essentially horizontal direction towards the said side pieces of the reflector, which reflect them in a direction essentially parallel to the optical axis so that they participate in the formation of the beam.

Preferably the light source is an elongated filament orientated in line with the optical axis.

Advantageously, the base part of the reflector extends forwards as far as the vertical plane perpendicular to the optical axis and passing through the light source.

In accordance with a first embodiment of the invention, the deflecting means, in projection in a horizontal plane, occupy on both sides of the optical axis an angular interval, relative to the light source, substantially equal to the angular interval occupied by the side pieces of the reflector, and the rays re-emitted by the side pieces of the reflector are contained in the respective vertical planes containing the incident rays.

In this case the deflecting means may comprise two toroidal lens elements centered on the light source and extending over the full height of the lamp, and each constituted by a succession of staged deflecting prisms.

Alternatively the deflecting means may comprise two toroidal lens elements centered on the light source and occupying an intermediate part of the height of the lamp, and constituted by a succession of staged deflecting prisms; and two pairs of auxiliary reflectors in the form of toroidal paraboloids having a vertical axis of rotation passing through the source and occupying, respectively above and below the toroidal lens elements, the remainder of the height of the lamp.

Preferably, in both cases, the side pieces of the reflector are parts of a parabolic cylinder with a vertical generatrix, having a vertical line passing through the light source as the focal line and the toroidal lens elements and the two pairs of auxiliary reflectors each occupy a third of the height of the lamp.

Finally, in accordance with a second aspect of the invention, the deflecting means comprise a toroidal lens element centered on the light source, extending over about 180° and in front of the latter, and occupying an intermediate part of the height of the reflector, the said element being constituted by a succession of staged deflecting prisms; and two pairs of auxiliary reflectors in the form of parabolic cylinders having a horizontal generatrix parallel to the optical axis, having the same focal line coincident with the said optical axis, and occupying, respectively above and below the toroidal lens element, the remainder of the height of the lamp, and the side pieces of the reflector comprise at the level of the said toroidal lens element, two parts of parabolic cylinder having a vertical generatrix, having a vertical line passing through the light source as the focal line, and above and below the said two parts, and at the level of the two pairs of auxiliary reflectors respectively, parts of two parabolic cylinders having a vertical generatrix, having respectively for focal lines, vertical lines situated on either side of the light source, both being at distances from the latter substantially equal to twice the focal distance of the auxiliary reflectors.

Other features and advantages of the present invention will emerge from the following detailed description of preferred embodiments of the invention, given by way of example only and with reference to the attached drawings.

DESCRIPTION OF THE PREFERRED EMBODIMENTS

Figure 1:
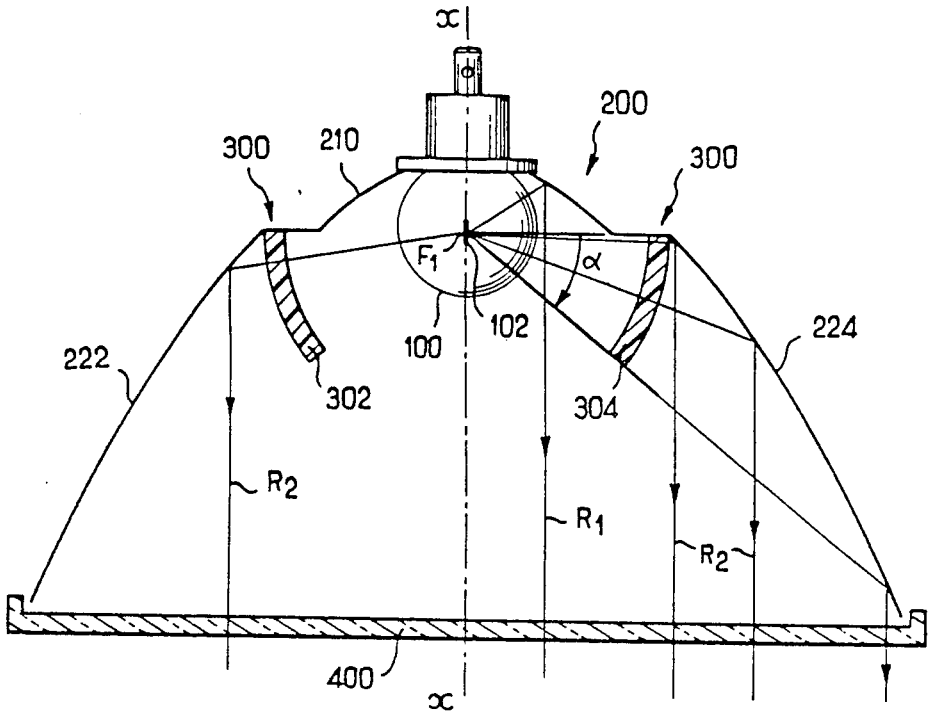
FIG. 1 is a view in horizontal section of a lamp according to a first embodiment of the invention.

With reference now to FIGS. 1 to 4, a headlamp conforming to a first embodiment of the present invention comprises a lamp 100, a complex reflector, indicated in total by 200, deflecting means 300 acting by refraction, and also a front closing glass 400.

The lamp 100 is provided with a filament 102 which will be considered to be cylindrical as a first approximation, disposed axially on the optical axis x—x of the lamp.

The reflector 200 comprises, first of all, a base part 210 which is in the form of a paraboloid of revolution, the focus of which $F_1$ is situated approximately at the center of the filament 102 on the axis x—x. Preferably, the ratio between its focal distance and the total height of the reflector is of the order of 1:4, for the purposes described hereinafter.

Figure 2:
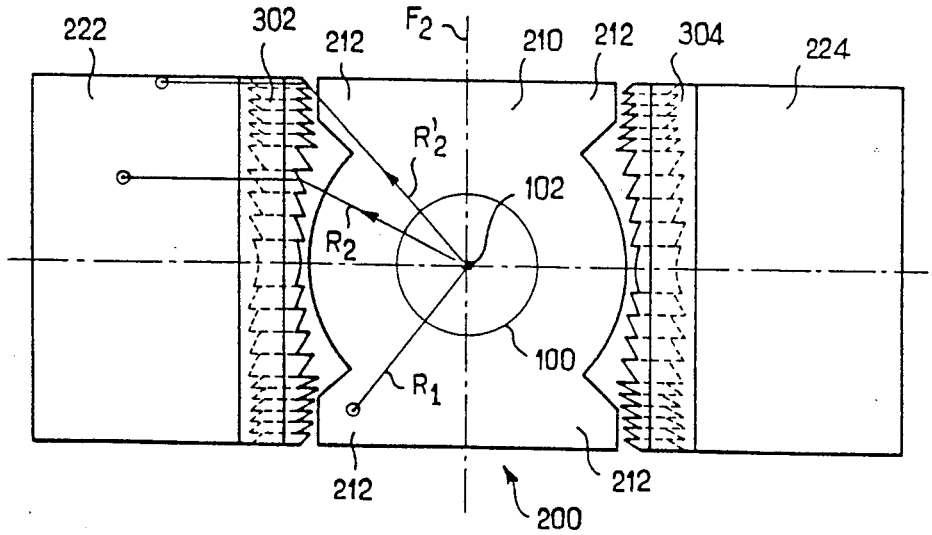
FIG. 2 is a front view of the lamp in FIG. 1, without its glass lens.

In its two lateral regions, the reflector 210 extends forwards as far as the vertical plane perpendicular to the optical axis x—x passing through the centre of the filament 102, as indicated by the lateral lines shown in FIG. 2 in the form or arcs of a circle centered on the filament.

In the upper and lower regions the base part 210 of the reflector is, on the other hand, prolonged towards the front, being delimited above and below by the two horizontal planes between which the lamp is contained. These prolongations are indicated by 212. In this way the reflector 210 covers more than the entire field of light emitted towards the rear by the filament 102.

The reflector also comprises two side pieces 222, 224 which cooperate with the deflecting means 300. More precisely, the deflecting means are constituted by two toroidal Fresnel lens elements having vertical axes, 302 and 304 respectively, focussed on the center of the filament 102 and comprising on their inner surfaces deflecting prisms staged in succession and contained in respective horizontal planes. The deflecting prisms can alternatively be formed on the outer surfaces of the lenses 302, 304.

It should be mentioned, and this applies to all the description, that a "toroidal" volume or surface means a volume or surface engendered by the rotation of a planar circumference and, by extension, of any planar curve, about an axis contained in the plane of the circumference or of the curve.

The two corresponding side reflectors 222, 224 are constituted by two symmetrical parts of the same parabolic cylinder having a vertical generatrix, focussed on a vertical focal line passing through the centre of the filament 102 (line $F_2$ in FIGS. 2 and 4), and having as plane/axis the vertical plane passing through the optical axis x—x.

As can be seen in FIG. 1, in projection in a horizontal plane, each toroidal lens and the associated side reflector covers the same angular interval of the light field of the filament. This interval begins at the level of the line transverse to the optical axis x—x which corresponds to the transition to the reflector base 210 and ends at an angle $\alpha$ defined by the position of the extreme lateral edge of the part 222 or 224 of the reflector 200 relative to the filament. Thus it can be seen that each toroidal lens 302, 304 stops substantially at the level of the line joining the said extreme edge of the associated part of the reflector 222, 224 to the filament 102.

Finally, although it has not been shown, the closing glass 400 may comprise slightly deflecting prisims or striae enabling a slight lateral spreading of the beam to be produced.

The headlamp described above behaves optically in the following manner.

First of all, the filament 102 and the reflector base 210 engenders, in a conventional manner, a beam of relatively high intensity light rays parallel to the optical axis (rays $R_1$ in FIGS. 1 to 4).

In addition, the light rays coming from the filament towards a lens 302 or 304 are bent down by the latter, the deflection being made in a vertical plane, in order to be propagated horizontally towards the associated side reflector 222 or 224. Since, by the very definition of the toroidal lens concerned, the ray thus deflected has as its vertual origin the vertical focal line $F_2$ of the reflector, it is thus reflected by the latter to be propagated after reflection in a horizontal direction substantially parallel to the optical axis Ox (rays $R_2$ in FIGS. 1 to 4).

Figure 3:
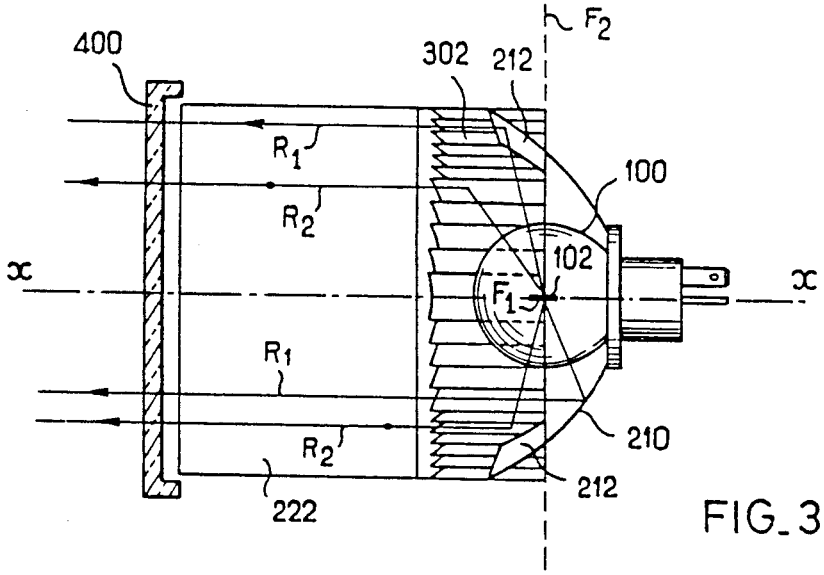
FIG. 3 is a view in vertical axial section of the lamp in FIGS. 1 and 2.
Figure 4:
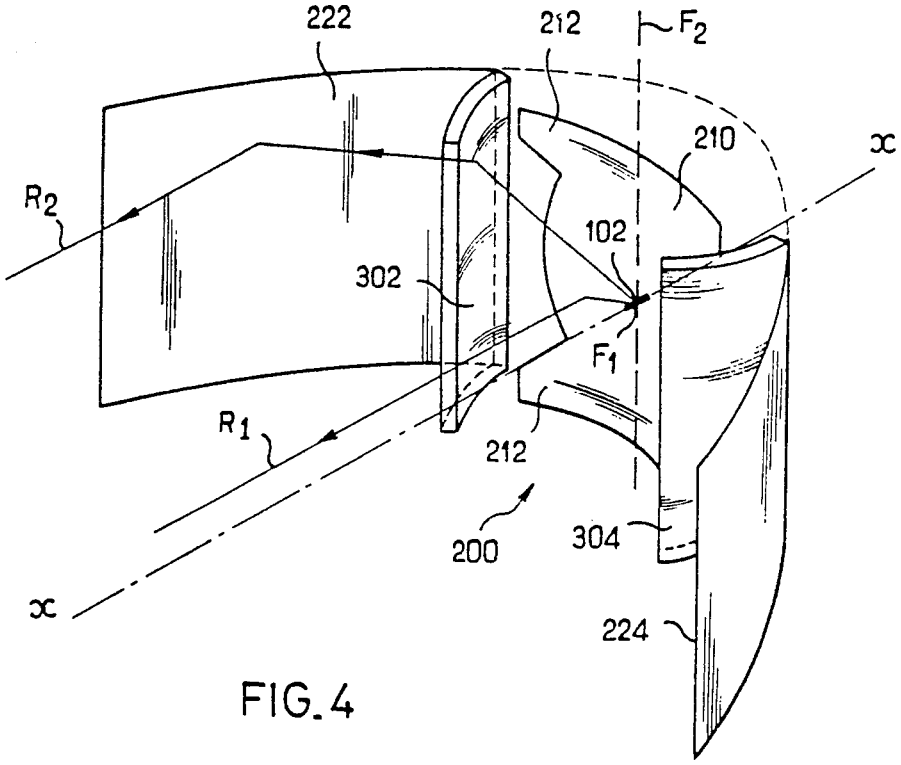
FIG. 4 is a partial perspective view of the lamp in FIGS. 1 to 3.

As can be clearly seen in FIGS. 2 and 3, the prolonged parts 212 of the reflector base 210 are defined starting from two preconsiderations. On the one hand, the reflector base thus designed does not obscure any of the light rays destined to be received by the toroidal lenses 302 and 304, the prolongations 212 situated on the same side defining between them a sort of window for these rays (see FIG. 4 in particular). On the other hand, such a reflector covers in an optimal way the rectangular zone reserved for the beam coming from this reflector, a zone which is defined by the free space existing on the one hand between the front vertical edges of the lenses 302 and 304 and, on the other hand, between the upper and lower horizontal limits of the lamp, as FIG. 2 clearly shows.

A headlamp such as that described above provides a recovery of the luminous flux emitted by the filament which is much greater than that of a lamp with a truncated paraboloid of the prior art. In fact the steeply ascending or descending rays, such as $R_2'$ (FIG. 2), which in the previous lamp would encounter the upper or lower cheek of the reflector and would thus be lost, are in this case to a large extent recovered by one of the lenses 302 and 304 and sent back towards the reflector on the corresponding side to participate in the formation of the beam. Only the rays very steeply inclined beyond about 45° or directed substantially towards the front, that is to say not included in the angular intervals $\alpha$ are not recovered.

Another advantage of the lamp conforming to the present invention is that the means of formation of the beam constituted by the lenses 302 and 304 and the side reflectors 222 and 224 produce images of the filament which are essentially horizontal or slightly inclined relative to the horizontal. In fact, the lenses, which are disposed to the side relative to the filament, form rays which on exit from them correspond to less inclined images of the filament, and reflection on the parabolic cylinders 222 or 224 has the feature of not accentuating this inclination.

Thus, the images of the filament have a predisposition to form a road beam, to which conventionally it would not be desirable to give an excessive depth so as not to illuminate the road too close to the vehicle.

In FIGS. 5 to 8 a headlamp is shown which conforms to a second embodiment of the present invention.

In these Figures, the elements or parts identical with or similar to those in FIGS. 1 to 4 are indicated by the same reference numbers, and will not be described in detail again.

As can be seen, the reflector base 210, which in this case again is in the form of a paraboloid of revolution focussed approximately on the centre of the filament 102, no longer comprises parts prolonged towards the front. Its contour is therefore (FIGS. 6 and 8) a circle centered on the filament 102 and contained in the plane perpendicular to the optical axis x—x passing through the filament. Moreover, the deflecting means 300 are composed of a plurality of elements, each respectively occupying about a third of the total height of the reflector.

In the center, at the level of the filament, the deflecting means are constituted by two toroidal lenses 302, 304 analogous to those of the first embodiment of the invention, except for the fact that they occupy a reduced height in the lamp.

The deflecting means 300 also comprise, above and below the toroidal lenses, four auxiliary reflectors 312, 322, 314, 324, each of which has the property of reflecting the light rays in such a way that after reflection they are propagated horizontally in the vertical plane containing the incident rays (rays $R_3$). It can be demonstrated that the reflecting surfaces having such a property are toroidal paraboloids, that is to say surfaces respectively produced by the rotation of a parabola, having a horizontal axis and a focus situated at the center of the filament 102, about a vertical axis passing through the center of the said filament.

More precisely, each of the two reflectors 312, 322, and 314, 324 are respectively situated on the same side belonging to one toroidal paraboloid, and the two toroidal paraboloids intersect each other at two points situated on the vertical line passing through the centre of the filament, at the levels of the upper and lower edges respectively of the toroidal lenses 302 and 304.

Figure 6:
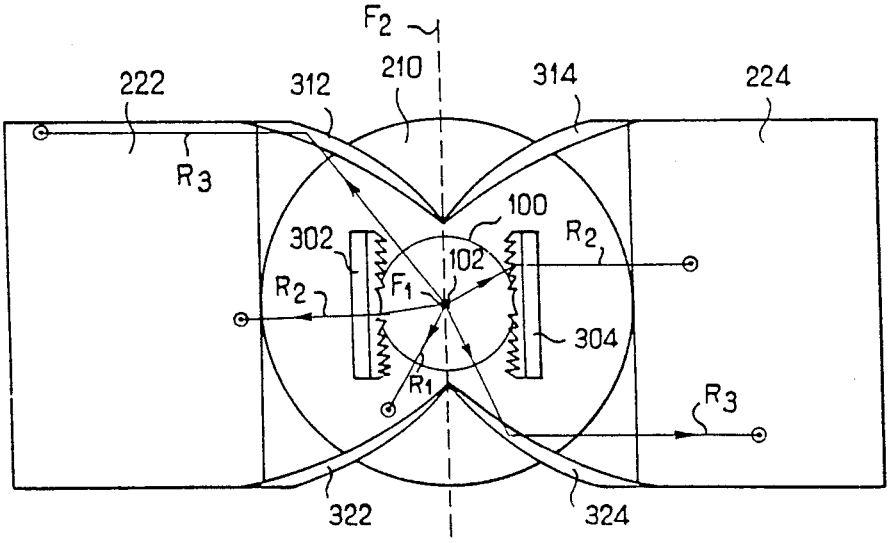
FIG. 6 is a front view of the lamp in FIG. 5, without its glass lens.
Figure 7:
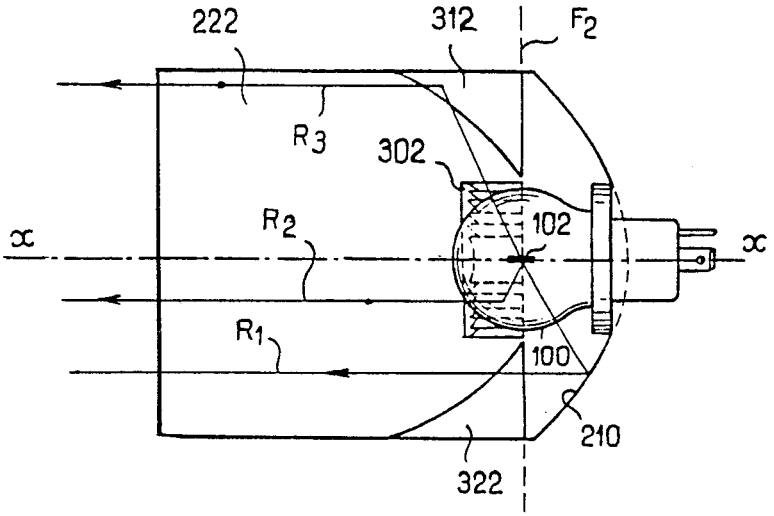
FIG. 7 is a view in vertical axial section of the lamp in FIGS. 5 and 6.
Figure 8:
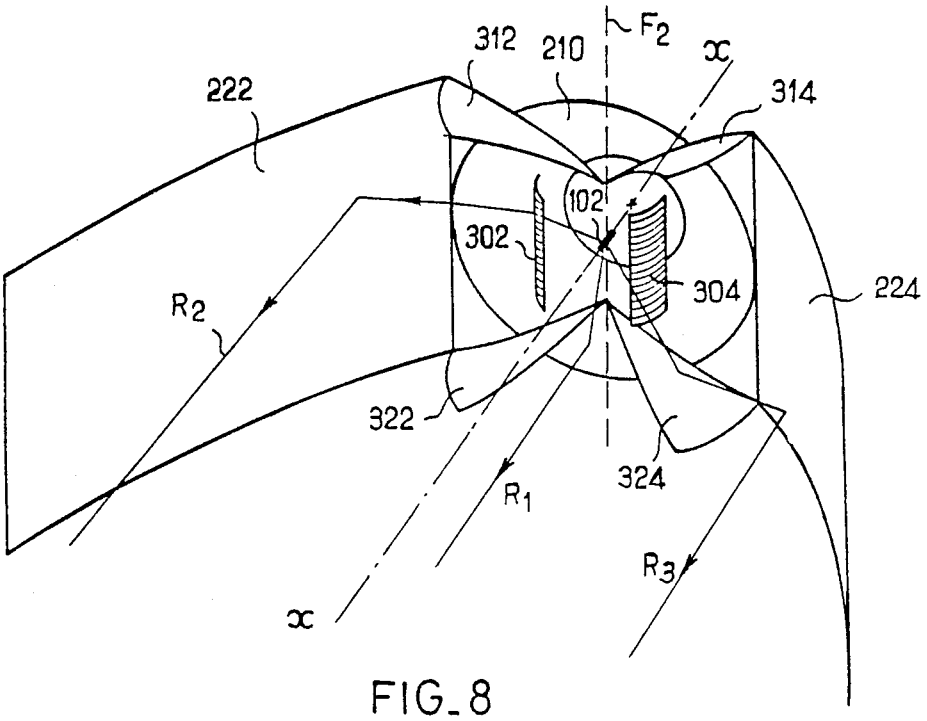
FIG. 8 is a partial perspective view of the lamp in FIGS. 5 to 7.
Figure 9:
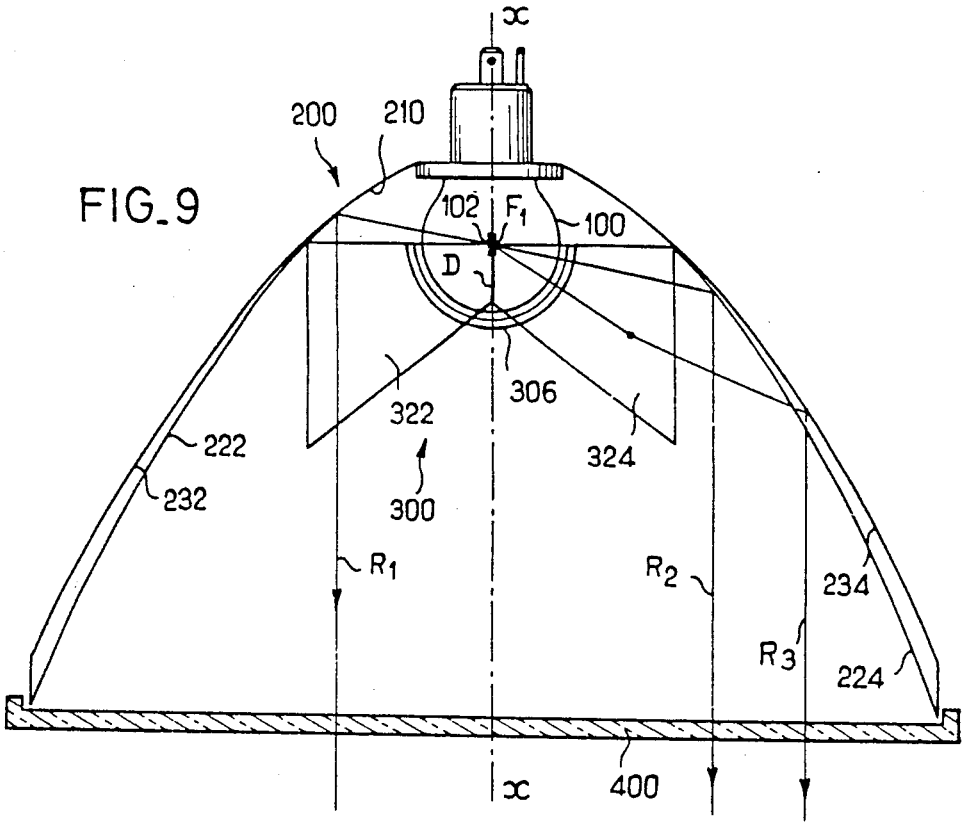
FIG. 9 is a view from above of a third embodiment of lamp.

Thus, in projection in the vertical plane of FIG. 6, it can be seen that the light rays emitted by the filament 102 are recovered over an angular extent of 360°, distributed between the toroidal lenses 302 and 304 and the returning reflectors 312, 314, 322, 324, and that these rays are sent back in a horizontal direction, all having a virtual origin and vertical line $F_2$ passing through the center of the filament.

In the same way as in the embodiment in FIGS. 1 to 4, the side reflectors 222 and 224 are then two symmetrical parts of the same parabolic cylinder having a horizontal generatrix, with a focal line $F_2$ and having as its plane-axis the vertical plane incorporating the optical axis x—x.

Figure 5:
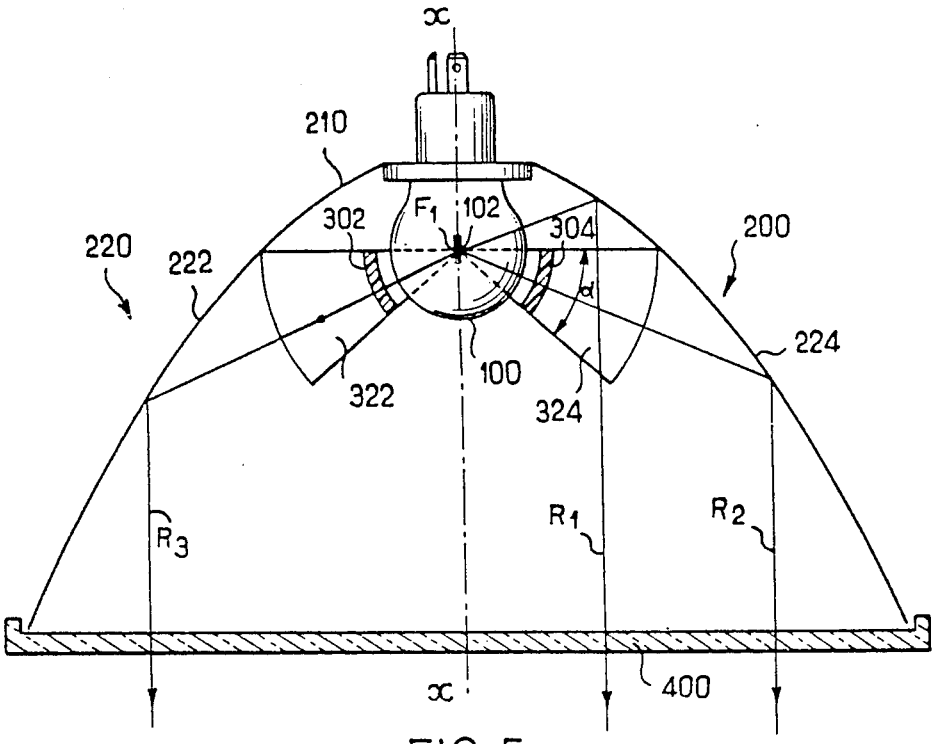
FIG. 5 is a view in horizontal section of a second embodiment of lamp.

As shown in FIG. 5, and by analogy with the first embodiment, the different elements constituting the deflecting means, in projection in a horizontal plane, have an operating angular extent (angle $\alpha$) comprised on each side between the horizontal line perpendicular to the optical axis x—x and the line joining the filament 102 to the extreme edge of the cylindrical-parabolic reflector concerned.

The optical behaviour of such a lamp is essentially similar to that of the embodiment in FIGS. 1 to 4, with the exception that the upper and lower parabolic toroidal reflecting surfaces of the deflecting means 300 replace the toroidal refringent lenses of FIG. 1. This results in an increased recovery of the rays emitted by the filament which are greatly inclined upwards or downwards, to the extent that these rays are included in the angular range $\alpha$ mentioned above, as in the first embodiment.

A third practical embodiment of the invention is shown in FIGS. 9 to 12 of the drawings. The elements or parts identical or similar to the preceding Figures will not be described in detail again.

In this embodiment, there is a reflector base 210 identical to that in FIGS. 5 to 8.

In so far as the combination of deflecting means 300/side reflectors is concerned, as in the second embodiment these may be separated into three distinct stages having heights which may be similar. The most obvious difference from the second embodiment is that the structural differences between the different stages is in this case also exhibited at the level of the side reflectors, as is shown particularly in FIG. 12.

More precisely, at the level of the filament 102 (central stage) the deflecting means comprise a toroidal lens element 306 similar in concept to the lenses 302, 304 of the preceding Figures, but which extends angularly, in projection in a horizontal plane, over 180° in front of the source. This lens 306 cooperates with the homologous reflecting zones 222 and 224 of the side pieces of the reflector which are symmetrical parts of a parabolic cylinder having a vertical generatrix as has been defined above.

The deflecting means comprise, in the upper and lower stages respectively, auxiliary reflectors 312, 314 and 322, 324, which are in the form of parabolic cylinders. More precisely, each auxiliary reflector is defined by a horizontal generatrix parallel to the optical axis x—x, being held on a parabola contained in a vertical plane perpendicular to the optical axis, having a horizontal axis and with a focus centered approximately at the centre of the filament 102.

Thus the two upper and lower auxiliary reflectors situated on the same side of the lamp form part of the same parabolic cylinder, and the two parabolic cylinders forming four auxiliary reflectors are symmetrical with respect to a vertical longitudinal plane of the reflector and cut each other off along central lines (reference D in FIG. 9) situated at the heights of the upper and lower edges of the lens 306.

However, in contrast to the toroidal paraboloids of FIGS. 5 to 8, these parabolic cylinders defining a part of the deflecting means 300 do not produce a line such as $F_2$ (FIGS. 6 to 8) as virtual source of reflected rays, but each produced another vertical line, $F_2'$ and $F_2''$ respectively, which can be demonstrated to be contained in the vertical plane passing through the center of the filament and perpendicular to the optical axis x—x, displaced laterally to the side opposite to that of the auxiliary reflector concerned.

More precisely, the two parabolic cylinders providing the top and bottom parts of the deflecting means 300 create in contrast to side reflectors, virtual sources in the form of vertical lines displaced respectively on each side of the filament at a distance about twice the focal distance of the said generatrices.

Consequently the side reflectors, in so far as the upper and lower stages are concerned, are parabolic cylinders having a vertical generatrix with a vertical plane-axis parallel to the optical axis x—x and focussed on the vertical focal lines $F_2'$ and $F_2''$ respectively. Consequently there is an offset, visible in particular in FIG. 12, between the upper and lower side reflectors, indicated by the references 234 and 242, 244, associated respectively with the cylindrical-parabolic auxiliary reflectors 312, 314 and 322, 324 of the deflecting means 300, and the intermediate side reflectors 222, 224 associated with the toroidal lens 306.

Optically, the lamp described above behaves in the following way.

Figure 10:
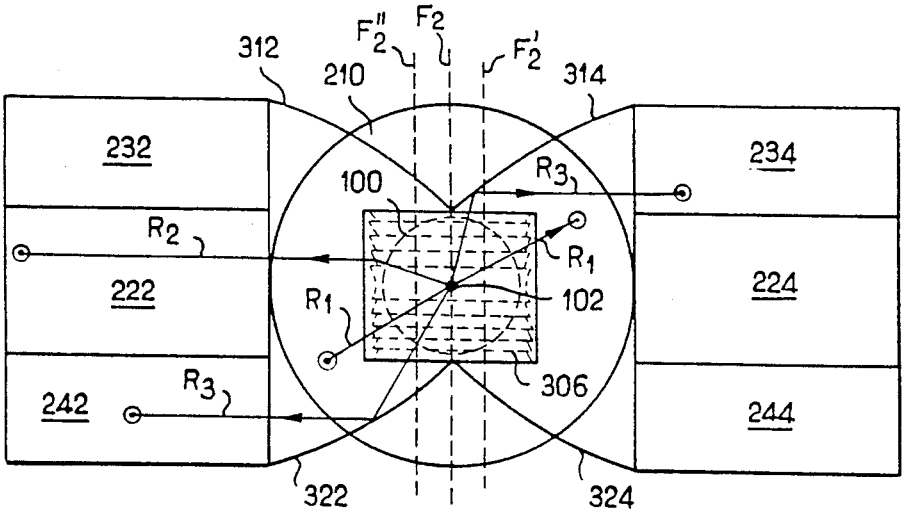
FIG. 10 is a front view of the lamp in FIG. 5, without its glass lens.
Figure 11:
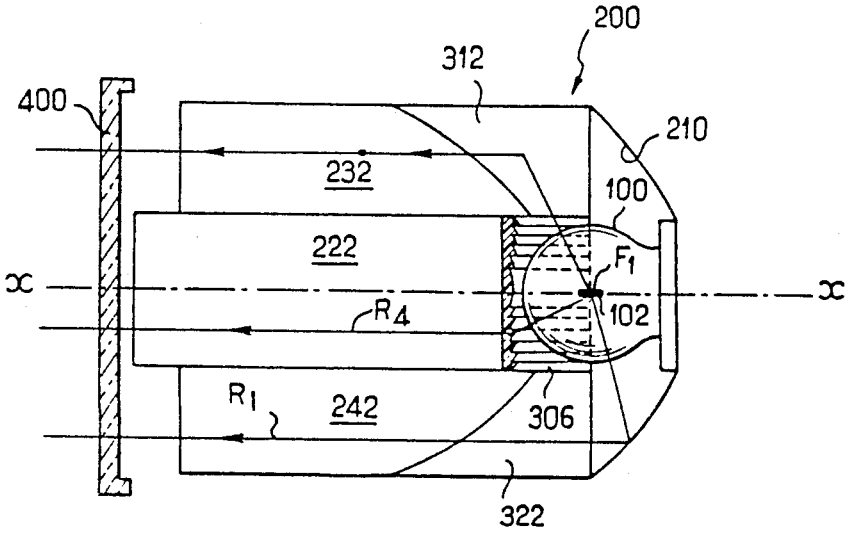
FIG. 11 is a view in vertical axial section of the lamp in FIGS. 9 and 10.

First of all, by virtue of the specific shape of the auxiliary reflectors, the latter obstruct practically none of the beam created by the reflector base 210. In fact, their characterization by a horizontal generatrix parallel to the emitting axis x—x is expressed in the fact that the lamp with their shape in the vertical plane of FIG. 10 is reduced to their section as the latter Figure shows.

Moreover, the rays coming from the filament towards any of the constitutive elements of the deflecting means 300 are first of all deflected by refraction (ray $R_2$) or reflection (ray $R_3$) in order to take a horizontal direction of propagation, then are received by the side reflectors 222, 224, 232, 234, 242, 244 to be reflected in a direction substantially parallel to the optical axis.

Moreover, in addition to the characteristics common to the three embodiments described, in this last embodiment, as indicated above, the toroidal lens extends in front of the filament. As a result the rays directed towards this lens and not received by the side reflectors contribute to form the part of the beam with a large width and small height over an angular extent of about 45° on both sides of the optical axis (ray $R_4$ in FIG. 11).

Figure 13:
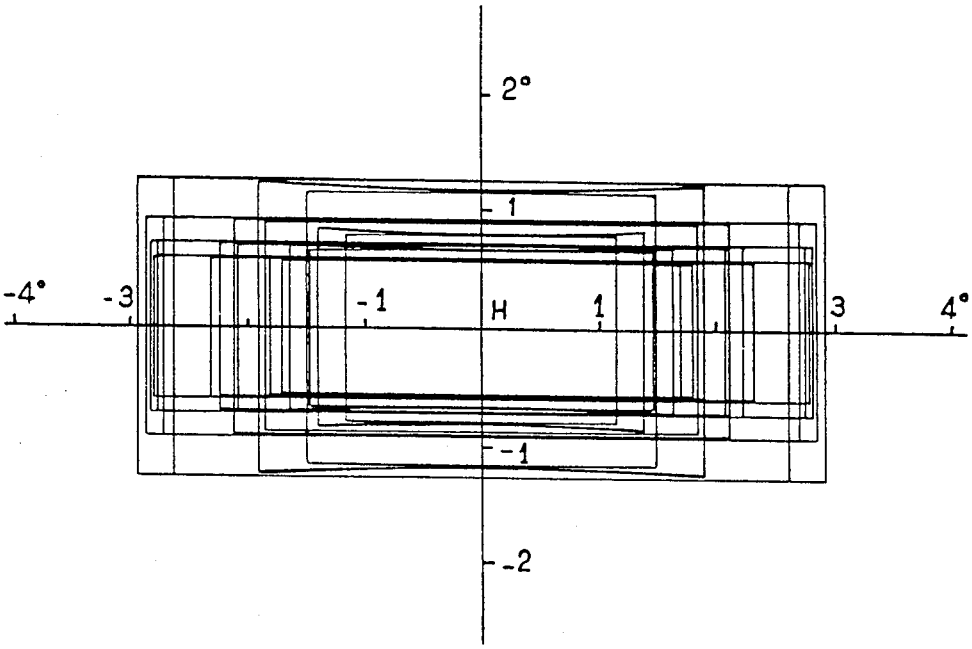
FIG. 13 shows, in a projected plane perpendicular to the optical axis, the position of a certain number of images of the filament, without the glass lens, produced by a part of the lamp in FIGS. 9 to 12.
Figure 12:
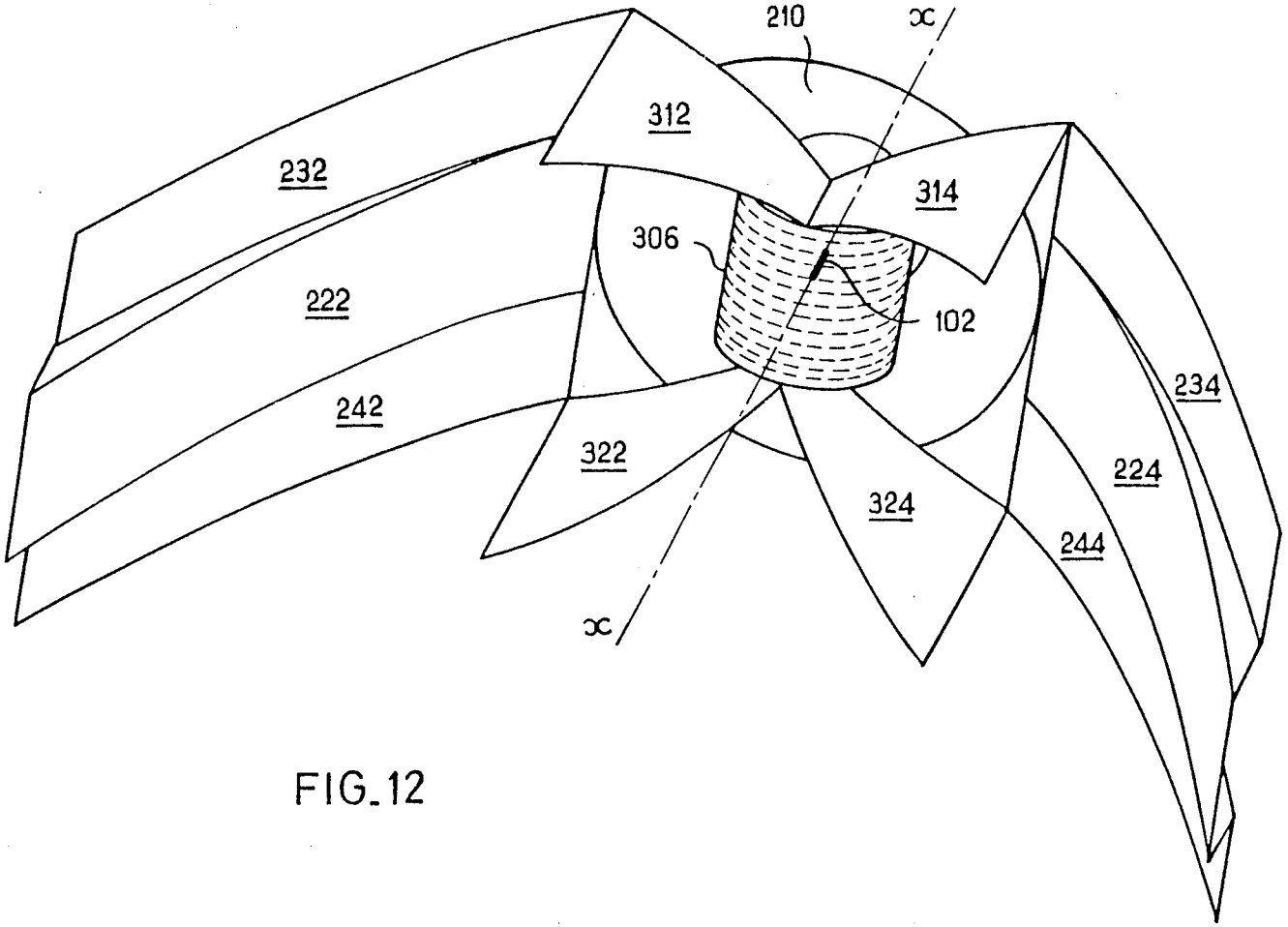
FIG. 12 is a partial perspective view of the lamp in FIGS. 9 to 11.

FIG. 13 shows, in a plane perpendicular to the optical axis, the position of a certain number of images of the filament of the sort which are produced by a part of the lamp in FIGS. 9 to 12, without its closing glass, and more particularly by the combination of auxiliary reflectors forming part of the deflecting means 300 and the corresponding side reflectors.

As a result of the intrinsic conception of these optical elements all the images of the filament 102 advantageously retain a strictly horizontal orientation after the double reflection, as FIG. 13 shows.

As a result these images are very well predisposed to form a road beam which, as has been indicated above, should have a large width and reduced height.

EXAMPLE

A lamp of prior art (Model A) in which the reflector was constituted by a paraboloid truncated by upper and lower cheeks has been compared with lamps made according to each of the three embodiments of the invention (Models No. 1 to 3 respectively).

In each case the dimensions of the output opening of the reflector were 80 mm×200 mm, and the basic focal distance of each of them was of the order of 20 mm, each lamp having a substantially identical depth.

The flux recovery was measured using the same bulb in each of the reflectors and by determining by calculation the solid angle over which the rays originating from the source were caught by the various elements of the optical system to participate in the formation of the beam. The results are presented in the following Table:

TABLE

| Model | Flux recovery |
|---|---|
| A | 65.0% |
| 1 | 70.0% |
| 2 | 75.0% |
| 3 | 80.0% |

Figure 14:
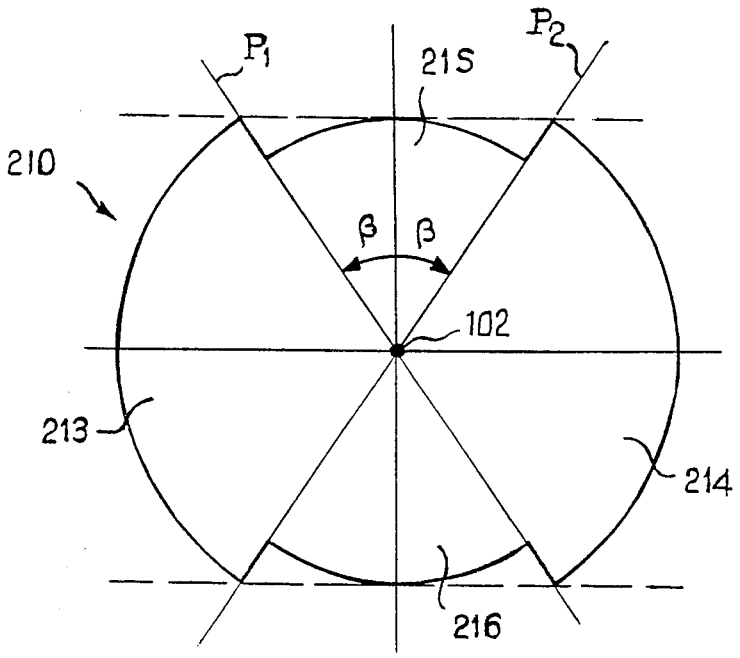
FIG. 14 is an alternative embodiment of a part of a lamp in accordance with the present invention.

This Table shows a clear superiority of the lamps conforming to the invention relative to those of the prior art. FIG. 14 shows, in front view, a variant of the base part 210 of the main reflector 200.

In accordance with this alternative, the base 210 comprises two side pieces 213, 214 and two parts respectively upper and lower 215 and 216, delimited by two planes $P_1$ and $P_2$ inclined at the same angle $\beta$ in two opposite directions on either side of the vertical axial plane of the lamp. The four parts are focussed on the filament or in its vicinity.

The side parts have a focal distance substantially equal to that of the side pieces in the form of parabolic cylinders 222, 224 of the reflector, whereas the upper and lower parts 215, 216 have a focal distance which, as described above, is determined as a function of this height of the reflector and, more precisely, equal to a quarter of this height.

The angle $\beta$ which characterizes the transition between the various parts of the reflector base 210 is itself preferably determined as a function of the focal distance of the side parts 213 and 214 and of the height of the reflector in such a way these parts d not project beyond the upper and lower limits of the said reflector. More precisely, the relationship 4f. sin $\beta \leq h$ should be checked.

This bifocal configuration of the reflector base is advantageous since it enables the reflector to extend laterally as far as the start of the lateral parabolic cylinders and moreover to provide an optional recovery of flux above and below, taking into account the height to which the reflector is limited.

The present invention is not limited to the various embodiments described above and shown in the drawings, but includes any variation or modification within the scope of the appended claims.

Thus, to the extent that they are compatible, the particular features of each of the three embodiments may be combined.

Moreover, the terms "horizontal", "vertical", "perpendicular", etc., used throughout the present description are to be considered in a broad sense, it being understood that small deviations relative to these geometric indications will result in lamps remaining viable in practice.

In addition, in so far as the production of the reflector is concerned, this can be made either by moulding in one piece, in which case its various parts will be kept attached, for example by lugs formed during moulding, or by moulding the various parts individually, and then subsequently assembling them for example by glueing. The closing glass may also be moulded from plastics material.

Finally, it has been indicated in the description that the reflector base preferably has, at least in its upper and lower regions, a focal distance equal to a quarter of the height of the lamp. In practice this enables the reflector to be given, when it is cut off at the level of the transverse vertical plane passing through its focus (through the filament) a height equal to that of the lamp, as can easily be demonstrated. However, it should be clearly understood that this will not constitute a limitation of the invention.

What is claimed is:

1. A headlamp for an automobile vehicle, of the kind comprising a light source, a reflector defining an optical axis, and a closing glass, wherein the reflector comprises a base part substantially in the form of a paraboloid of revolution focussed on the light source, and side pieces in the form of parabolic cylinders having a vertical generatrix, and said headlamp further comprises a deflecting means extending near the source substantially over the full height of the headlamp and adapted to deflect the direction of the light rays coming from the source in order to re-emit them in an essentially horizontal direction towards the said side pieces of the reflector, which in turn reflect them in a direction essentially parallel to the optical axis to participate in the formation of the beam.

2. A headlamp according to claim 1, wherein the light source is an elongated filament orientated along the optical axis.

3. A headlamp according to claim 1, wherein the base part of the reflector extends forwards as far as the vertical plane perpendicular to the optical axis and passing through the light source.

4. A headlamp according to claim 1, wherein the deflecting means, in projection in a horizontal plane, occupy on both sides of the optical axis an angular interval relative to the light source which is substantially equal to the angular interval occupied by the side pieces of the reflector, and the rays re-emitted by the side pieces of the reflector are contained in the respective vertical planes containing the incident rays.

5. A headlamp according to claim 4, wherein the deflecting means comprise two toroidal lens elements centered on the light source and extending over the full height of the lamp, and each constituted by a succession of staged deflecting prisms.

6. A headlamp according to claim 5, wherein the side pieces of the reflector are parts of a parabolic cylinder having a vertical generatrix, having a vertical line passing through the light source as the focal line.

7. A headlamp according to claim 6, wherein the toroidal lens elements and the two pairs of auxiliary reflectors each occupy a third of the height of the headlamp.

8. A headlamp according to claim 4, wherein the deflecting means comprise two toroidal lens elements centered on the light source and occupying an intermediate part of the height of the lamp, and constituted by a succession of staged deflecting prisms, and two pairs of auxiliary reflectors in the form of toroidal paraboloids having a vertical axis of rotation passing through the source and occupying, respectively above and below the toroidal lens elements, the remainder of the height of the lamp.

9. A headlamp according to claim 8, wherein the side pieces of the reflector are parts of a parabolic cylinder having a vertical generatrix, having a vertical line passing through the light source as the focal line.

10. A headlamp according to claim 9, wherein the toroidal lens elements and the two pairs of auxiliary reflectors each occupy a third of the height of the headlamp.

11. A headlamp according to claim 1, wherein the deflecting means comprise a toroidal lens element centered on the light source, extending over about 180° in front of the latter, and occupying an intermediate part of the height of the reflector, the said element being constituted by a succession of staged deflecting prisms, and two pairs of auxiliary reflectors in the form of parabolic cylinders having a horizontal generatrix parallel to the optical axis, having the same focal line coincident with the said optical axis, and occupying, respectively above and below the toroidal lens element, the remainder of the height of the headlamp, and wherein the side pieces of the reflector comprise at the level of the said toroidal lens element, two parts of a parabolic cylinder having a vertical generatrix, having a vertical line passing through the light source as the focal line; and above and below the said two parts, and at the level of the two pairs of auxiliary reflectors respectively, parts of two parabolic cylinders having a vertical generatrix, having respectively as focal lines, vertical lines situated on either side of the light source, both being at distances from the latter substantially equal to twice the focal distance of the auxiliary reflectors.

* * * * *